US006431492B1

(12) United States Patent
Chillscyzn

(10) Patent No.: US 6,431,492 B1
(45) Date of Patent: Aug. 13, 2002

(54) INTEGRATED ADJUSTABLE CORE SUPPORT AND MEDIUM GUIDE DEVICE

(75) Inventor: Steve Chillscyzn, MoorPark, CA (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/428,017

(22) Filed: Oct. 27, 1999

(51) Int. Cl.[7] ..... B65H 16/06

(52) U.S. Cl. ..... 242/577; 242/596.1; 242/596.7; 242/596.8; 242/615

(58) Field of Search ..... 242/577, 577.1, 242/577.4, 596.1, 596.8, 596.7, 566, 615, 615.1, 575.2, 575.3, 573.4, 571, 577.2, 577.3, 573.9, 575

(56) References Cited

U.S. PATENT DOCUMENTS

| | | | | | |
|---|---|---|---|---|---|
| 323,012 | A | * | 7/1885 | Withington | 242/575 |
| 825,951 | A | * | 7/1906 | Adams | 242/575 |
| 1,887,269 | A | * | 11/1932 | Knittle | 242/596.8 |
| 2,046,883 | A | * | 7/1936 | Robbins | 242/577.4 |
| 2,113,701 | A | * | 4/1938 | Mayer | 242/571 |
| 2,182,108 | A | * | 12/1939 | Anderson | 242/596.1 |
| 2,341,957 | A | * | 2/1944 | Storey | 242/575 |
| 2,532,185 | A | * | 11/1950 | Nicholas | 242/575 |
| 3,105,654 | A | * | 10/1963 | Czapla | 242/577.1 |
| 3,955,772 | A | * | 5/1976 | Chisholm et al. | 242/566 |
| 4,705,227 | A | * | 11/1987 | Honegger | 242/575 |
| 5,515,059 | A | * | 5/1996 | Gudgeon et al. | 242/566 |
| 5,758,841 | A | * | 6/1998 | Ayffre et al. | 242/575.3 |
| 5,813,343 | A | * | 9/1998 | Harb | 242/596.1 |

* cited by examiner

*Primary Examiner*—John M. Jillions
(74) *Attorney, Agent, or Firm*—Fulbright & Jaworski, LLP

(57) ABSTRACT

An integrated adjustable core support and medium guide device comprises a left support member, a right support member substantially parallel to the left support member, and a connecting mechanism coupled between the left and the right support members at opposite ends, the left support member having a left adjustable core support ear integrated with a left guide wall and a left guide rail, the right support member having a right adjustable core support ear integrated with a right guide wall and a right guide rail, the left and the right core support ears respectively including a semicircular upper half securely coupled to the left and the right support members respectively and including a semicircular lower half movably coupled to the left and the right support members respectively, the lower halves being vertically adjustable and the connecting mechanism being laterally adjustable of its width.

21 Claims, 6 Drawing Sheets

FIG. 1(b)
PRIOR ART
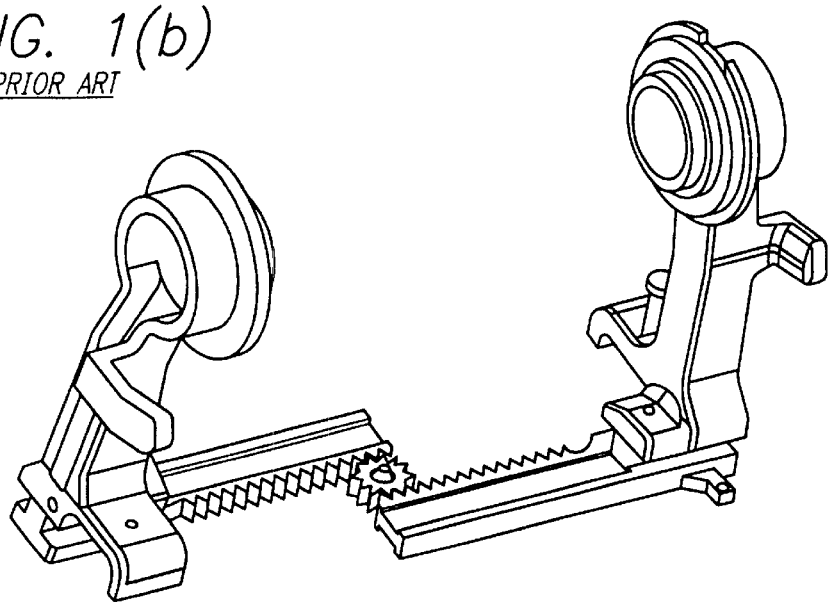
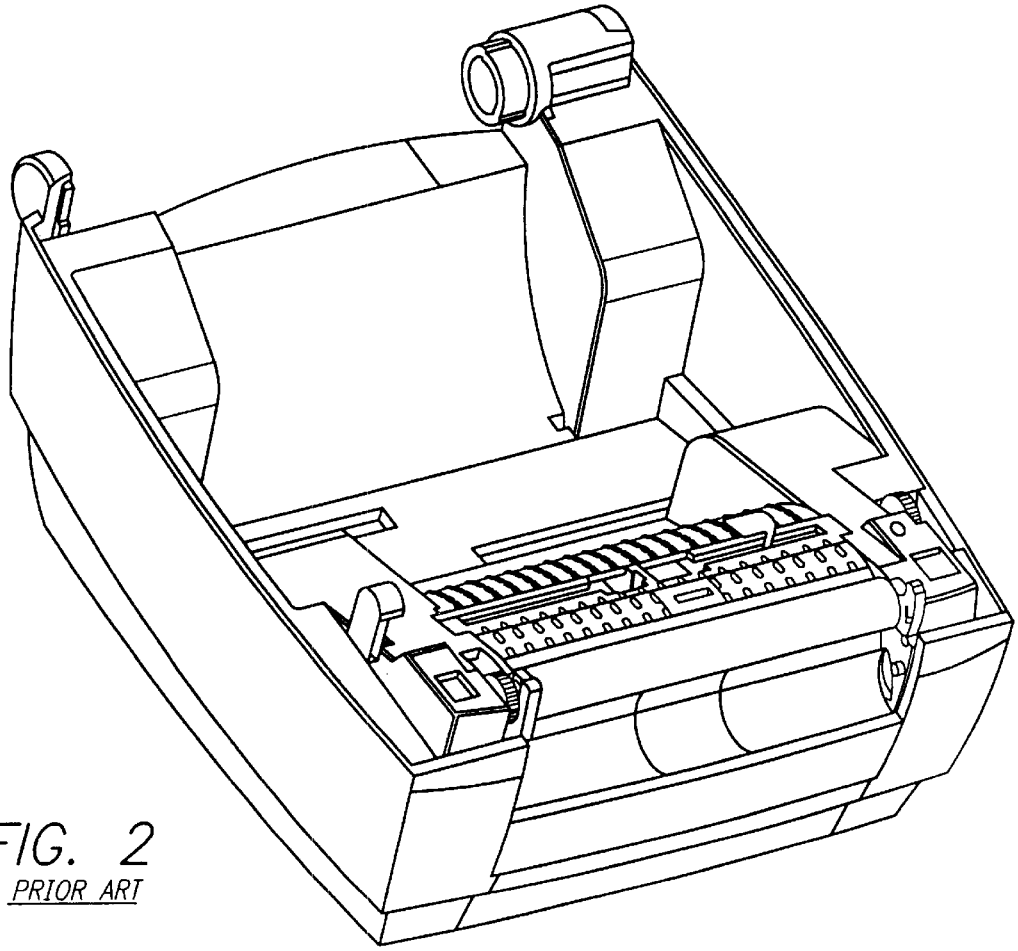
FIG. 2
PRIOR ART

INTEGRATED ADJUSTABLE CORE SUPPORT AND MEDIUM GUIDE DEVICE

FIELD OF THE INVENTION

The present invention relates generally to an image forming machine and, more particularly, to an integrated adjustable core support and medium guide device adapted to be incorporated into a printer for properly holding medium rolls having different core diameters and for better aligning medium strips of the medium rolls moving from the core support to the medium guide of the integrated device.

BACKGROUND OF THE INVENTION

Many conventional printers have certain medium holding mechanisms for supporting media mounted thereon. Typically, each of the media includes a medium strip wound on a support core forming a medium roll to be mounted on the medium holding mechanism of a conventional printer. The medium strip may be formed by a label strip, which includes a plurality of labels attached to a protective backing strip, or it may simply be formed by a paper strip. The protective backing of the label strip normally has a glossy surface attached to an adhesive surface of each label so that the labels could be easily peeled off from the protective backing. Each label also has a printable surface located opposite its adhesive surface.

Different conventional printers may have different kinds of medium holding mechanisms designed to fit their particular purposes. Ordinarily, the support core of the medium roll is tubular-shaped. The tubular support core could be made of plastic, cardboard, or any other materials that are suitable to hold the medium strip for mounting on the medium holding mechanism of the printer. The support core has an inner diameter and an outer surface where the medium strip is wrapped thereon. There are many different sizes of media used in the market for various business purposes. Thus, sizes of the support cores, e.g., the diameters and/or the lengths of the cylindrical support tubes,of the medium rolls have to be: accordingly varied in order to support different-sized medium strips. As a result, many commercially available medium rolls have different sizes of the inner diameters of their respective support cores.

As mentioned, commercially available medium rolls often come with different sizes. Therefore, medium holding mechanisms of most conventional printers have incorporated certain adjusting features to cope with the different-sized core diameters of the medium rolls. Typically, the medium holding mechanism of a conventional printer has a pair of support ears respectively positioned at opposite sides of the conventional printer. Each of the support ears respectively has a stepped shape for receiving different diameters of the support cores of the medium rolls. The stepped support ears of most conventional printers normally have at least two or three steps, but four-step support ears could also be found frequently.

Alternatively, the medium holding mechanism of a conventional printer may include a medium bar for supporting the medium rolls. The medium bar is normally secured to the conventional printer at one end, leaving an opposite end of the medium bar open for inserting and removing the medium rolls on the medium bar. Similar to the above-mentioned support ears, the medium bar often has a stepped shape to receive the medium rolls with different core diameters.

The conventional printer also has a medium guide mechanism for guiding and/or aligning the medium strip through the printer. Typically, the medium guide mechanism has a pair of pathway guides respectively positioned at opposite sides of a guide shaft. The pathway guides are positioned in the printer to guide the medium strip before the medium strip could reach a print head of the printer, thereby they help align the medium strip with the print head to provide better printing qualities. Each of the pathway guides often has a thin slot to allow the medium strip to pass through and both of the pathway guides are movably coupled to the guide shaft. Furthermore, the pathway guides are often equally spaced apart at opposite sides from a midpoint of the guide shaft. To accommodate medium strips having different dimensions, the pathway guides are configured to move toward or away from the midpoint of the guide shaft with. equal distance. Ordinarily, this is accomplished by a wheel-controlled sliding arrangement, where a user may adjust the distance between the pathway guides by turning an adjusting wheel. As a result, the pathway guides would always center the medium strip when the medium strip passes through the pathway guides. Alternatively, only one of the pathway guides is movably coupled to the guide shaft, while the other pathway guide is secured to an end of the guide shaft. Consequently, such pair of the pathway guides operates only to guide the medium strip and does not provide any centering function.

The above-mentioned stepped feature of the medium holding mechanism of the conventional printer provides a convenient solution to accommodate medium rolls having different core diameters of their support tubes. This feature, however, only partially solves the problems of holding the printable medium rolls having different core diameters. Particularly, a typical conventional printer has two or three steps on each support ear. As a result, only those medium rolls having core diameters fitted to these two or three steps will be held properly in the printer. Other medium rolls having different core diameter sizes will be, at best, loosely supported by the support ears. A loose medium roll mounted in the printer would potentially cause many problems during operation, such as the misalignment of the medium strip in the printer or the jamming of the printer due to uneven moving speed of the medium strip.

To reduce the loose-medium-roll problem, more, steps will have to be provided by the support ears. This arrangement would inevitably increase the overall width of the conventional printer due to the stepped feature of the support ears. As can be seen in FIG. 1, a conventional medium holding mechanism of a printer normally has two or more steps for each support ear (at least one step for each support ear is required). Each step of a support ear will need at least a certain amount of depth, e.g., 5 mm, on its rim in order to securely support the medium rolls. As a result, the overall width of the conventional medium holding mechanism will be increased by 2×D for each additional step of the support ear, where D is the depth of each step (supposed each step has the same depth D). The more steps adopted for each support ear, the wider medium holding mechanism, and thus the printer, is required. Furthermore, even though more steps may be able to fit more types of medium rolls, no conventional printer has an adjustable medium holding mechanism to fit many commercially available medium rolls with different core diameter sizes of their support tubes.

Another common problem to the conventional printer relates to the alignment of the medium strip between the medium guide mechanism and the medium holding mechanism. The medium guide mechanism in the conventional printer is separated and operated independently from the printer's medium holding mechanism. Ordinarily, the medium guide mechanism is located close to a front end of the printer, where the print head is located, while the medium holding mechanism is located close to a back end of the printer. After mounted on the medium holding mechanism, the medium strip of the medium roll is pulled forward and inserted through the slots of the pathway guides of the medium guide mechanism. Thereafter, the medium strip is threaded through between a platen and the print head, where the platen rotatably presses the medium strip tightly against the print head to move the medium strip forward for printing. As mentioned, at least one of the pathway guides is usually controlled by a wheel to adjust their relative positions. The wheel is coupled to the guide shaft and is positioned at one side of the printer near the front end. In the conventional printer, the adjusting wheel operates independently from the medium holding mechanism and is adapted to be manually, controlled.

Since the medium guide mechanism and the medium holding mechanism of the conventional printer are separately adjusted and operated independently from each other, misalignment problems, thus, often occur to the medium strip when it moves from the medium holding mechanism to the medium guide mechanism of the printer. For example, when mounting the medium roll in the printer, the user will have to adjust the pathway guides and/or the support ears to accommodate the newly installed medium roll. Moreover, the misalignment problems will be further deteriorated if the medium rolls are loosely mounted on the support ears. Since the pathway guides and the support ears are adjusted independently, the medium strip might not be precisely aligned between the support ears of the medium holding mechanism and the pathway guides of the medium guide mechanism. Even a slight misalignment of the medium strip between these two mechanisms might cause many potential problems to the conventional printer. The problems include, inter alia, the twisting of the medium strip, which may cause bad printing quality to the medium strip, or it may jam the conventional printer. An improved holding and guiding mechanism of the printer is, therefore, needed to resolve the above-mentioned problems.

SUMMARY OF THE INVENTION

An object of the present invention is to provide an improved holding mechanism to a printer for properly holding medium rolls having different core dimensions of their support tubes. Another object of the present invention is to provide an integrated, medium guiding mechanism for better aligning the medium strip of the medium roll mounted on the printer. These objects are met by providing an adjustable core support mechanism and an integrated medium holding and medium guiding device to a printer respectively according to the present invention, as indicated in the claims appended hereto.

In one embodiment of the present invention, the present invention comprises a medium holding mechanism having an adjustable core support ear for receiving medium rolls having different core dimensions. In another embodiment, the present invention comprises an integrated medium holding and medium guiding device. The integrated medium device includes a medium holding mechanism and a medium guiding mechanism integrally coupled to the medium holding mechanism forcing the medium guiding mechanism to remain aligned with the medium holding mechanism. In addition, the medium holding mechanism is adjustable of its width to hold medium rolls of different lengths.

In a preferred embodiment, the integrated medium device according to the present invention has a pair of side support members respectively positioned at opposite ends of the integrated medium device. The side support members are coupled to each other through a connecting gear mechanism. The connecting gear mechanism comprises a gear set meshing to a pair of tooth rails for moving both side support members away or toward each other. Each of the side support members respectively comprises an adjustable core support ear, a guiding rail, and a guiding wall, preferably integrated with a respective side support member. Moreover, each of the adjustable core support ears has an upper semi-circular half and a lower semi-circular half, wherein the lower semi-circular half is adapted to be adjusted vertically for supporting medium rolls having different core dimensions of their support tubes. Since the core support ear, the guide rail, and the guide wall are integrated. with respective side support members, the medium strip will remain aligned when it moves from the medium roll, which is mounted on the adjustable core support ears, to a pair of guide caps respectively positioned over, the top of the guide rails at the front end of each side support member.

The foregoing and other objects, features and advantages of the invention will be apparent from the more particular description of preferred embodiments of the present invention, as illustrated in the accompanying drawings in which like reference characters refer to the same parts throughout the different views. The drawings are not necessarily to scale, emphasis instead being placed upon illustrating the principles of the invention.

BRIEF DESCRIPTIONS OF THE DRAWINGS

FIG. 1*a* shows the prospective view of a conventional printer having a pair of support ears for holding a medium roll.

FIG. 1*b* illustrates a connecting mechanism coupling both support ears of FIG. 1*a*.

FIG. 2 shows the perspective view of a conventional printer having a pair of pathway guides.

Figure 4:
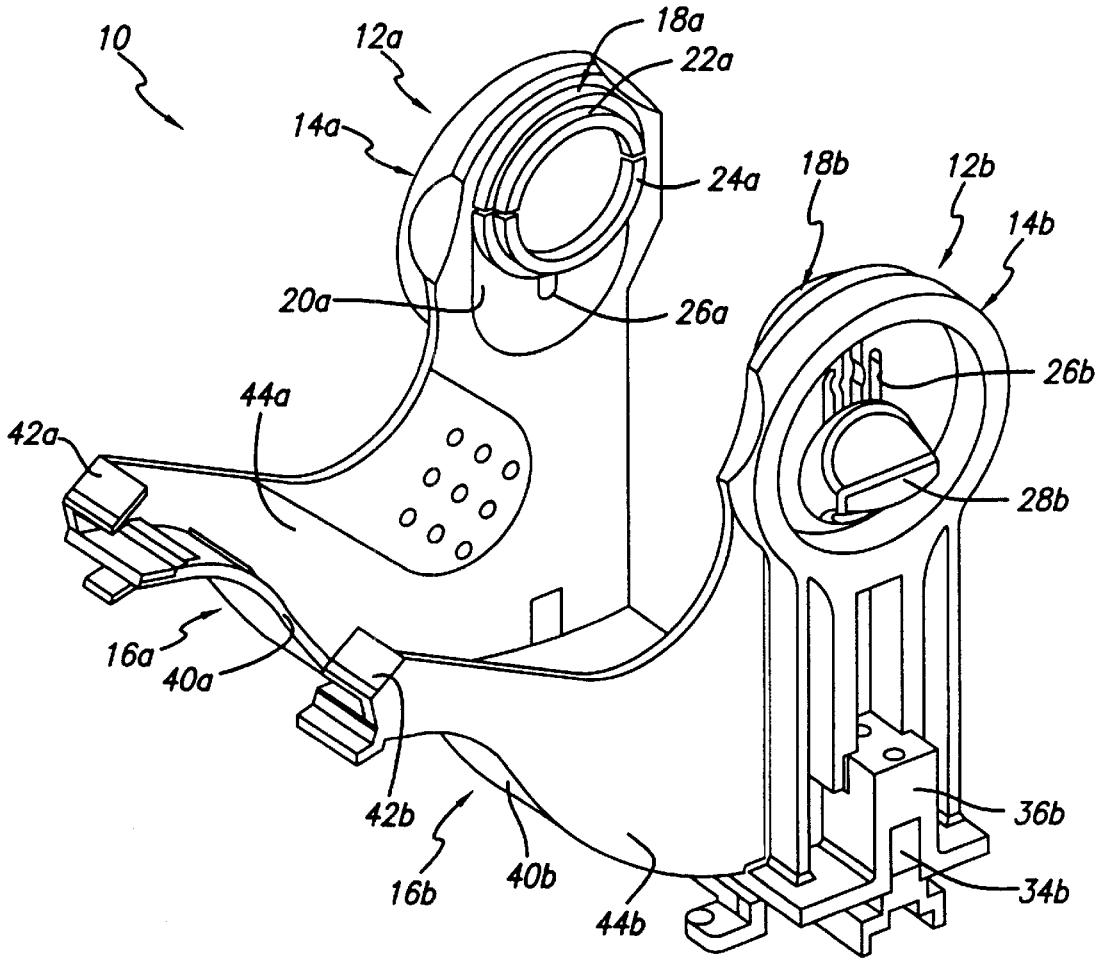
FIG. 4 shows a detailed perspective view of the integrated medium device of FIG. 3.
Figure 5A:
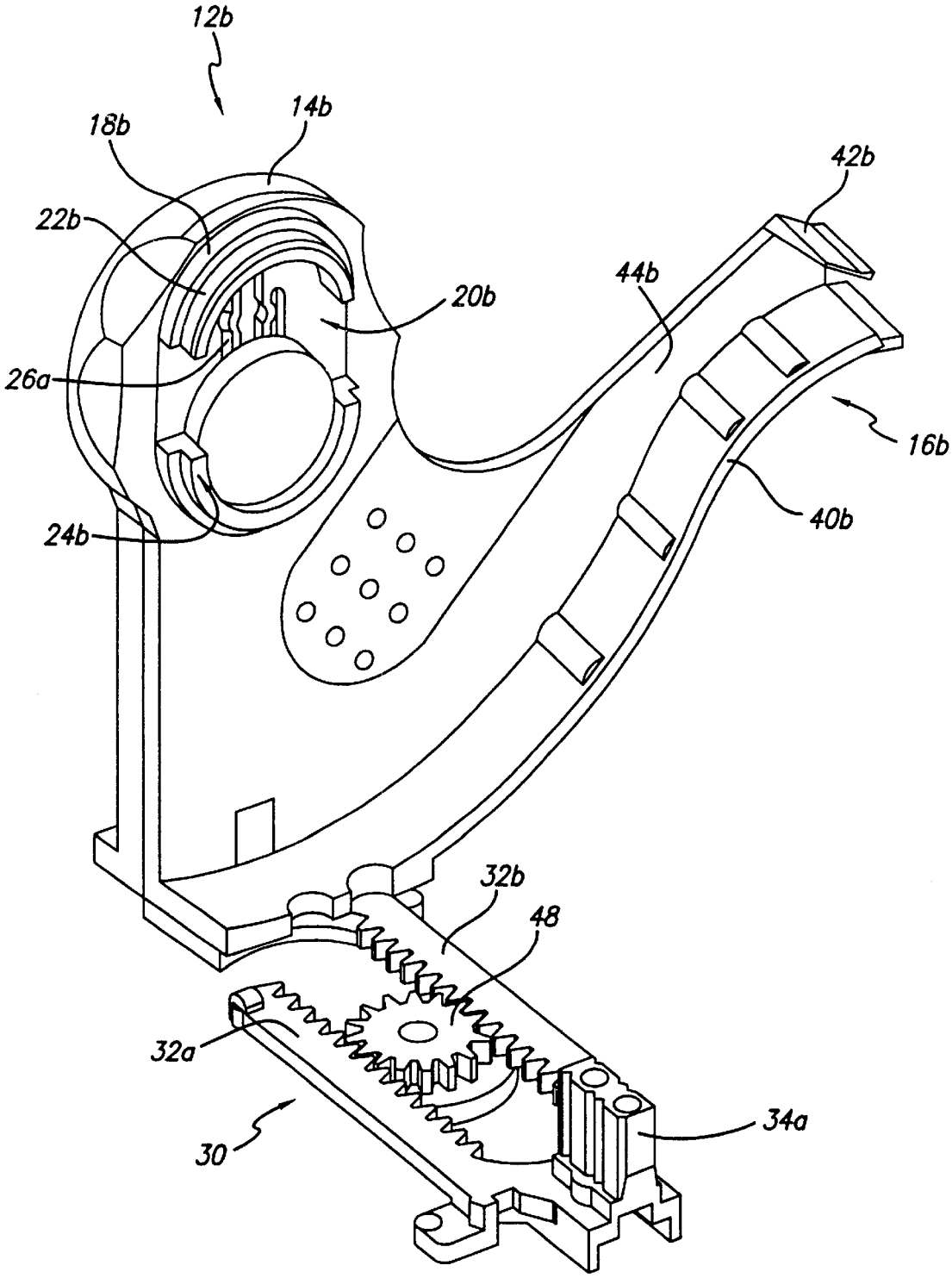

FIG. 5*a* shows a right part of the integrated medium device of FIG. 4 with a connecting mechanism.

Figure 5B:
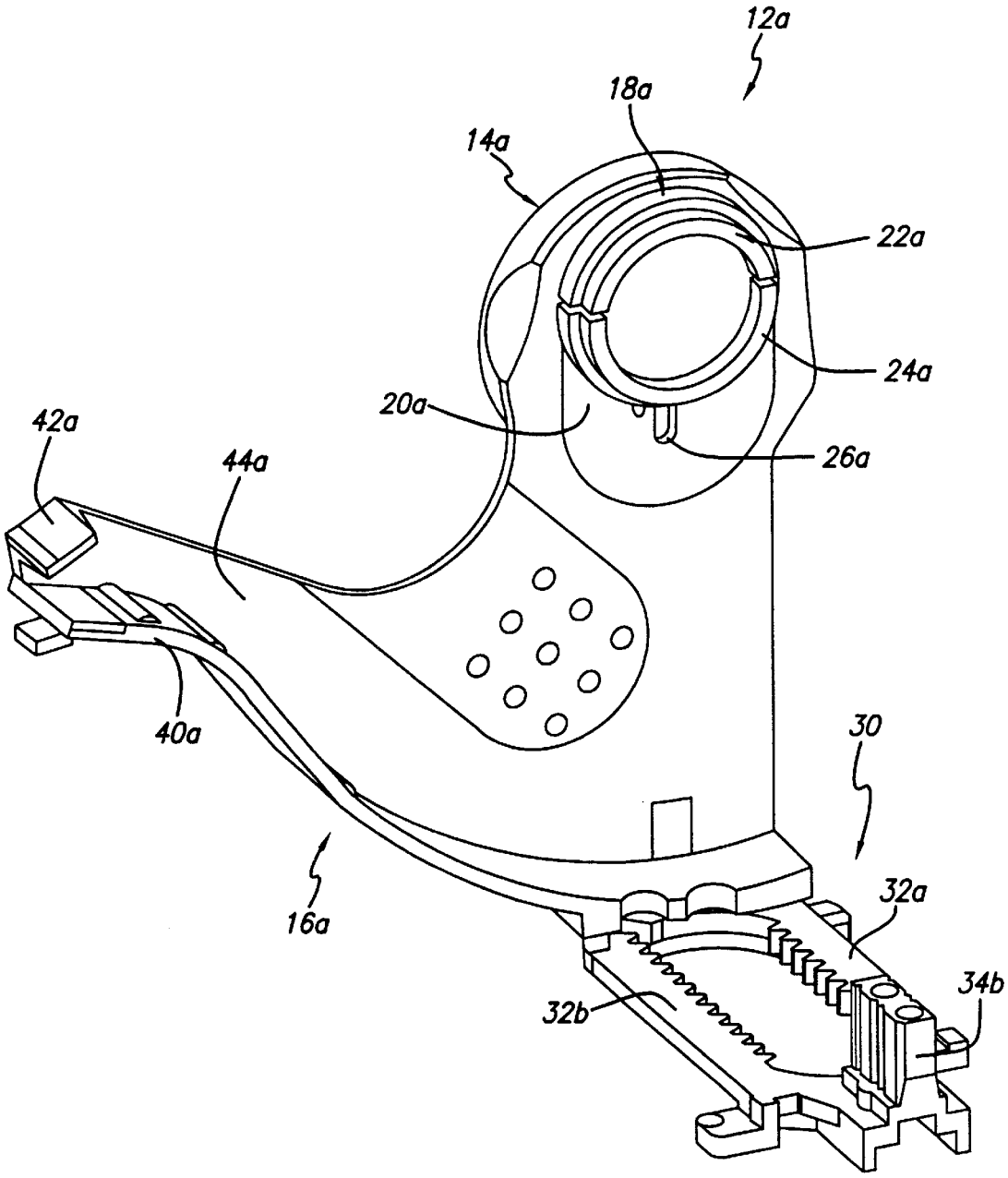

FIG. 5*b* shows a left part of the integrated medium mechanism of FIG. 4 with the connecting mechanism.

DETAILED DESCRIPTION OF THE INVENTION

Figure 3:
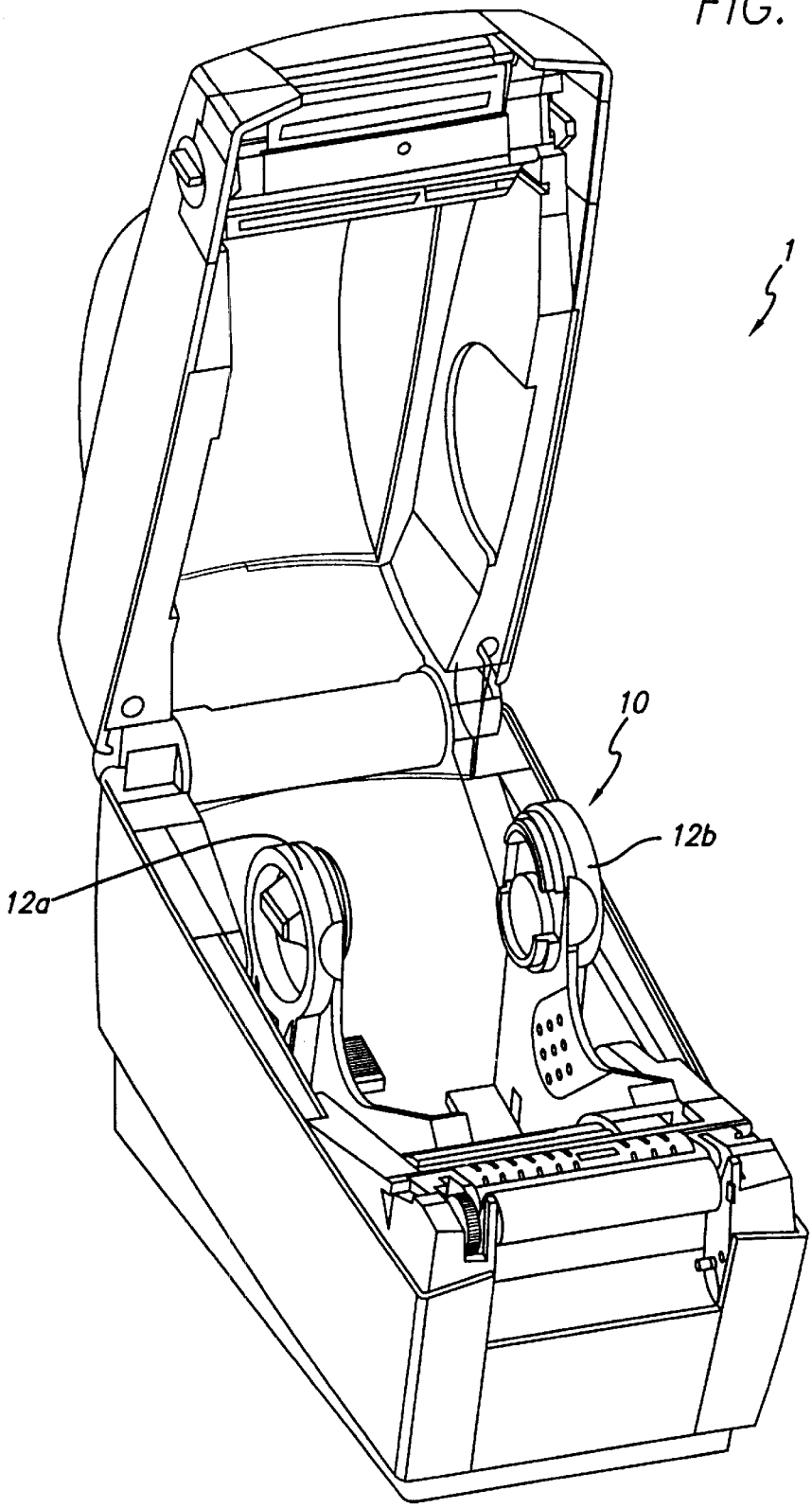
FIG. 3 shows a perspective view of an integrated medium device incorporated into a printer according to the present invention.

FIG. 3 shows a preferred embodiment of the present invention having an integrated medium device 10 being incorporated into a printer 1. The integrated medium device 10 includes a pair of side support members 12*a* and 12*b* coupled to each other through a connecting mechanism 30. The side support members 12*a* and 12*b* are respectively positioned at the inner left and right sides of the printer 1 and are substantially parallel to each other, where medium holding sections 14*a* and 14*b* respectively of the side support members 12*a* and 12*b* are located near a back end of the printer 1, and medium guiding sections 16*a* and 16*b* are located near a front end of the printer 1. In the preferred embodiment, the side support members 12*a* and 12*b* are made of molded plastic materials. In alternative embodiments, other suitable materials may be used to make the side support members 12*a* and 12*b*.

As mentioned, each of the side support members 12*a*, 12*b* of the integrated medium device 10 has a medium holding section 14*a*, 14*b* and a medium guiding section 16*a*, 16*b* integrated with the respective medium holding sections 14*a*, 14*b*, as shown in FIG. 4. Each of the medium holding sections 14*a*, 14*b* comprises an adjustable core support ear 18*a*, 18*b* respectively positioned on a shallow elliptic recess 20*a*, 20*b* of the respective left and right side support members 12*a*, 12*b*. In the preferred embodiment, the medium holding sections 14*a*, 14*b*, which include an adjustable core support ear respectively, are integrated with respective medium guiding sections 16*a*, 16*b*. In an alternative embodiment, the medium holding sections 14*a*, 14*b*, which respectively comprises an adjustable core support ear 18*a*, 18*b*, are separated from the medium guiding sections 16*a*, 16*b*. In yet another alternative embodiment, the medium holding sections 14*a*, 14*b*, which includes no adjustable core support ear, are respectively integrated with the medium guiding sections 16*a*, 16*b*.

The core support ears 18*a*, 18*b* are respectively divided into an upper and a lower semi-circular ear parts (22*a*, 24*a*) and (22*b*, 24*b*), and diameters of the core support ears 18*a*, 18*b* are approximately equal to the short diameter of the elliptic recesses 20*a*, 20*b*. The upper ear parts 22*a*, 22*b* of each core support ears 18*a*, 18*b* are securely coupled to the left and right side support members 12*a*, 12*b* respectively, while the lower ear parts 24*a*, 24*b* are vertically movable along the respective elliptic recesses 20*a*, 20*b*.

In the preferred embodiment, the upper and lower ear parts (22*a*, 24*a*) and (22*b*, 24*b*) of the core support ears 18*a*, 18*b* respectively has a two-step stepped support rim, i.e., a larger base step and a smaller inner step on top of the base step. The outer diameter of the base step is approximately 1.125 inches wide and the outer diameter of the inner step is approximately 1 inch wide. The rim thickness of the inner step is approximately 0.1 inches, and the depth of both steps are also approximately 0.1 inches. In an alternative embodiment, the multiple-step feature of the core support ears 18*a*, 18*b* could be saved, leaving only one step to each core support ear 18*a*, 18*b*.

Two sets of three elongated slots 26*a* and 26*b* are vertically positioned respectively on the elliptic recesses 20*a* and 20*b*. Each vertical slot of the sets 26*a*, 26*b* is substantially parallel to each other, wherein a left and a right slot of each set 26*a*, 26*b* respectively has the length of approximately 0.75 inches and both middle slots have the length of approximately 1 inch. Moreover, both middle slots respectively have a pair of curved recess sections respectively located near the top and the bottom of each middle slot and respectively have a narrower straight intermediate section in between the top and the bottom curved recess sections. Thus, the wall-to-wall distances of each top and each bottom curved recess sections of both middle slots are wider than the wall-to-wall distances of the straight sections of the middle slots. A handle post is perpendicularly coupled to and extending backward from respective backsides of the lower ear parts 24*a* and 24*b* through the middle slots. The diameters of the handle posts are slightly larger than the wall-to-wall widths of the straight sections of the middle slots but are narrower than the wall-to-wall widths of the top or the bottom curved recess sections of the middle slots. Furthermore, the position of the top recess section of each middle slot is chosen to make each lower ear part 24*a*, 24*b* meet with the upper ear part 22*a*, 22*b* to form a respective circular core support ear 18*a*, 18*b* when the handle post of each core support ear 18*a*, 18*b* is rested on the respective top recess section. Likewise, the position of the bottom recess section of each middle slot is chosen to allow the lower ear parts 24*a* and 24*b* position at its lowest position within the elliptic recesses 20*a* and 20*b* when the handle post of each core support ear 18*a*, 18*b* is rested on the respective bottom recess section of each middle slot. As illustrated in FIG. 5, the right lower ear part 24*b* is at its lowest position in the recess 20*b* (FIG. 5*a*), and the left lower ear part 24*a* is at its uppermost position in the recess 20*a* (FIG. 5*b*).

A pair of adjusting nobs 28*a* and 28*b* are respectively coupled to the handle posts of the lower ear parts 24*a* and 24*b* for manually adjusting vertical positions of the lower ear parts 24*a* and 24*b*. One of the middle slot walls, such as the wall between the middle and the left slots or between the middle and the right slots, of the left side support member 12*a* is broken at just above the top recess section. Similarly, one of the middle slot walls of the right side support member 12*b* is broken at just above its top recess section. As a result, the broken slot walls of the middle slots could be pushed sideways to allow the handle posts of the lower ear parts 24*a* and 24*b* to move up and down along their respective middle slots. As mentioned, the diameters of the handle posts are slightly larger than the wall-to-wall widths of the straight sections of the middle slots but are smaller than the wall-to-wall widths of the top and the bottom curved recess sections. Therefore, when the handle posts are pushed by the adjusting nobs 28*a*, 28*b* to move up and down the middle slots, the broken slot walls of each middle slot will be urged sideways to give way to the handle posts until the handle posts are rested on the top or the bottom curved recess sections of the middle slots. However, although the broken slot walls would be pushed aside to allow movements of the handle posts, the straight sections between the top and the bottom recess sections of both middle slots would clamp the handle posts tightly when the handle posts are positioned between their respective recess sections. The broken slot walls, thus, respectively function like a pivoted leaf spring for pressing the handle posts tightly. As a result, the lower ear parts 24*a* and 24*b* respectively of the support ears 18*a*, 18*b* could be held stationary at any vertical positions from the very top positions directly adjacent to the upper ear parts 22*a* and 22*b* to the lowest points of the elliptic recesses 20*a*, 20*b*.

The pairs of the upper ear parts and the lower ear parts (22*a*, 24*a*) and (22*b*, 24*b*) together hold the tubular cores of the medium rolls to be mounted on the support ears 18*a* and 18*b*. Since positions of the lower ear parts 24*a* and 24*b* respectively of each support ear 18*a* and 18*b* could be vertically adjusted, the support ears 18*a* and 18*b* of the present invention could hold medium rolls with a wide variety of core diameter sizes sufficiently tight. Therefore, the integrated medium device 10 according to the present invention prevents the medium rolls from being held loosely on the support ears 18*a*, 18*b*, as commonly happened to the conventional printers, and it also prevents many problems associated with the loose medium rolls. Moreover, the integrated medium device 10 of the present invention also minimizes the necessary thickness for the support ears 18*a* and 18*b*, as compared to the conventional printer which requires multiple steps of their support ears for holding medium rolls having different diameters of their support tubes. The present invention, thus, makes it possible for a small dimension printer to have a medium holding mechanism adapted to support a wide variety of medium rolls.

Figure 1A:
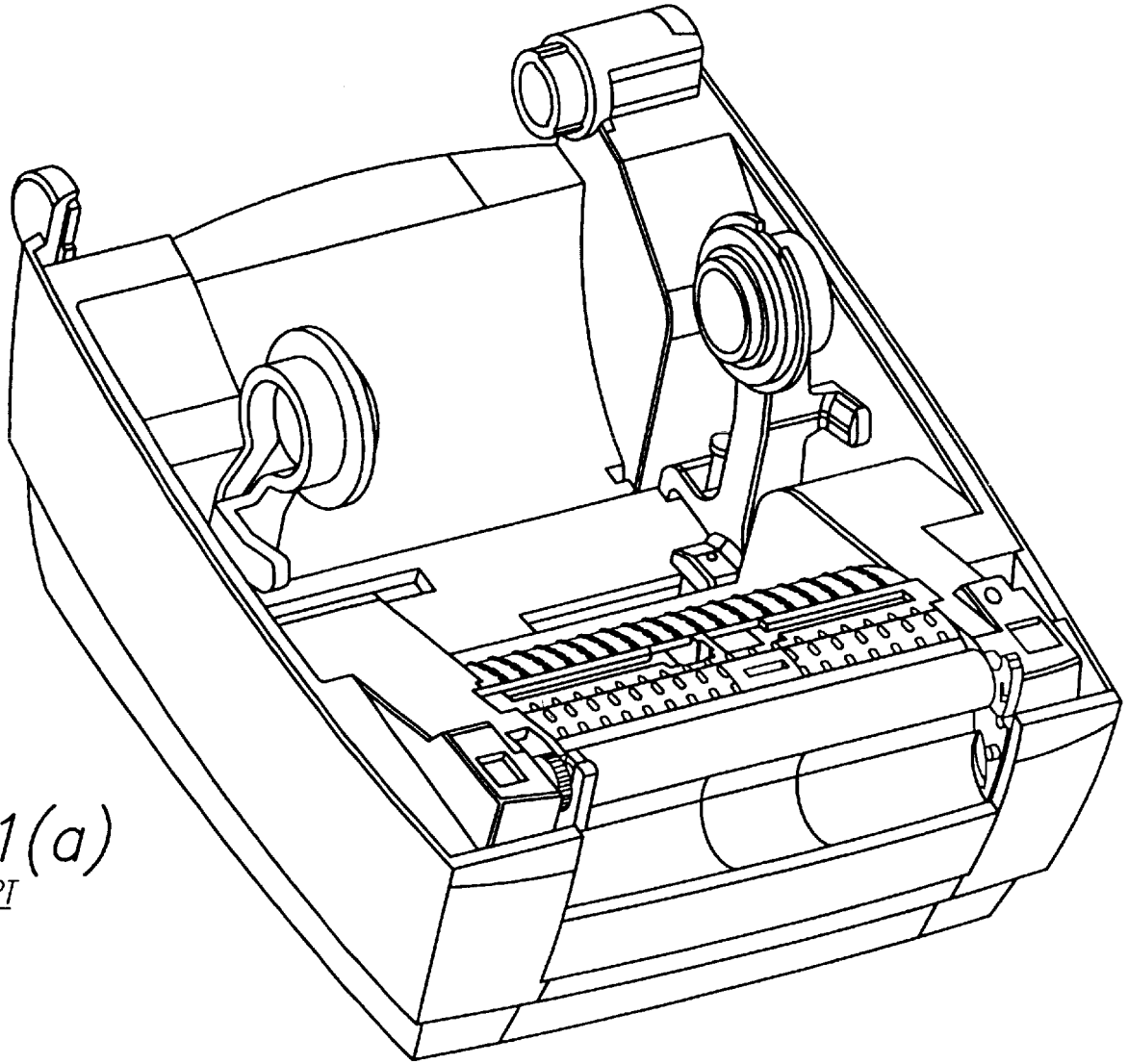
FIG. 1(a) PRIOR ART

The left and right side support members 12*a* and 12*b* are coupled to each other by a connecting mechanism 30, as partially shown in FIGS. 5*a* and 5*b*. Similar to FIG. 1*b* of the conventional printer, the connecting mechanism 30 of the present invention includes a rear and a front saw-like tooth arms 32*a*, 32*b* respectively secured to the bottom of the left and right side support members 12*a*, 12*b* and extending perpendicularly to their respective inner surfaces. In the preferred embodiment, the rear and the front tooth arms 32*a*, 32*b* respectively has wedge-like coupling parts 34*a*, 34*b* coupled to the tooth arms 32*a*, 32*b* at their respective ends. Correspondingly, the left and right side support member 12*a*, 12*b* respectively has receptive caps such as receptive cap 36*b* (FIG. 4) for receiving the wedge coupling parts 34*a*, 34*b*, as illustrated in FIG. 4. In addition, each of the wedge parts 34*a*, 34*b* has two holes perpendicularly located at the top of the wedge parts 34*a*, 34*b*. Likewise, each of the receptive caps such as receptive cap 36*b* (FIG. 4) respectively has two matching holes through the top of the receptive caps 36*a*, 36*b*. Thus, when the wedge parts 34*a*, 34*b* are wedged into the respective receptive caps 36*a*, 36*b*, two securing poles (not shown) could be inserted into the holes of the wedge parts 34*a*, 34*b* through the receptive caps 36*a*, 36*b* for holding the wedge parts 34*a*, 34*b* firmly in place.

Each of the tooth arms 32*a*, 32*b* has teeth only at one side wherein the teeth of both arms 32*a* and 32*b* face each other when mounted. As in the conventional printer, the connecting mechanism 30 further comprises a gear means 48 positioned between the tooth arms 32*a*, 32*b* and meshing with the teeth of the tooth arms 32*a*, 32*b*. As a result, when it rotates, the gear means 48 will pull the side support members 12*a* and 12*b* closer or will push them away from each other, depending on the rotational directions of the gear means 48. Preferably, the gear means 48 is positioned at the center between the side support members 12*a* and 12*b*. Therefore, the gear means 48 will pull or push both side support members 12*a* and 12*b* with equal distance. The gear means 48 of the present invention is similar to a gear means of the conventional printer shown in FIG. 1*b*. In the preferred embodiment, the gear means 48 is coupled to a rotational wheel (not shown) for the user to rotate the gear means to adjust the positions of the side support members 12*a*, 12*b*. The rotational wheel is also conventional. In an alternative embodiment, no rotational wheel is provided. The user then adjusts the positions of the side support members 12*a*, 12*b* by manually pressing them together or by pulling them away from each other.

As noted, each side support member 12*a*, 12*b* of the preferred embodiment has an integrated medium guide section 16*a*, 16*b* respectively located at the front part of the side support member 12*a*, 12*b*. The medium guide section 16*a*, 16*b* respectively has a curved shape guide rail 40*a*, 40*b*. Each curved guide rail 40*a*, 40*b* extends from the bottom of the medium holding section 14*a*, 14*b* frontward and upward until the horizontal position of the front end of the guide rail 40*a*, 40*b* is approximately 0.25 inches lower than the bottom of the lower ear part 24*a*, 24*b* at its uppermost position and approximately 0.25 inches higher than the bottom of the lower ear part 24*a*, 24*b* at its lowest position in the recesses 20*a*, 20*b*. Thus, the front ends of the guide rails 40*a*, 40*b* are approximately at the height in the middle of the swing span of the bottoms of the respective lower ear parts 24*a*, 24*b*.

The medium guide sections 16*a*, 16*b* also have flat cover hats 42*a*, 42*b* respectively located at the front end of the medium guide sections 16*a*, 16*b*. Each cover hat 42*a*, 42*b* extends perpendicularly inward from side walls 44*a*, 44*b* of the side support member 12*a*, 12*b* respectively and is substantially parallel to their corresponding guide rails 40*a*, 40*b* at the front end, as shown in FIG. 4. The flat cover hat 42*a*, 42*b* is approximately angled 10°–20° downward to its front, making the front end opening of the medium guide section 16*a*, 16*b* smaller and forcing the medium strip to move downward toward a print head (not shown) of the printer 1.

The medium guide sections 16*a*, 16*b* are respectively rigidly integrated to the medium holding sections 14*a*, 14*b* through the side walls 44*a*, 44*b* of the side support members 12*a*, 12*b* according to the present invention. When the medium holding sections 14*a* and 14*b* are adjusted to receive a medium roll, the medium guide sections 16*a*, 16*b* will be adjusted accordingly. As a result, the medium guide sections 16*a*, 16*b*, particularly at their respective front ends, will always align with the medium holding sections 14*a*, 14*b* no matter how the latter would move. The present invention, thus, provides an integrated medium device 10 for assuring the medium strip of the medium roll mounted thereon will remain aligned when the medium strip moves from the medium roll toward the front ends of the medium guide sections 16*a*, 16*b*. In addition, when the user mounts the medium roll on the printer 1, the user needs only to adjust the medium holding sections 14*a*, 14*b* and doesn't need to worry about the alignment of the medium guide sections 16*a*, 16*b* since they are self-aligned. In contrast, users of conventional printers need to independently adjust both their medium holding mechanism and the medium guiding mechanism to align both mechanisms with respect to each other. This would potentially cause many undesirable misalignment problems.

From the foregoing, it will be appreciated that, although specific embodiments of the invention have been described herein for purposes of illustration, various modifications may be made by persons skilled in the art without deviating from the spirit and/or scope of the invention. Particularly, the dimensions of the various parts of the present invention are for illustrative purposes only. Any persons skilled in the art may modify the dimensions of the present invention according to their particular purposes for different imaging devices. In addition, the present invention could also be used in all kinds of imaging machines, including but not limited to printers and fax machines, etc. The present invention may also be used in other medium-roll-mounting devices for better aligning the medium strips with respect to the medium rolls when the medium strips move through the devices.

What is claimed is:

1. An apparatus for mounting print media rolls of different core diameters, said apparatus comprising a first support member having a first print media holding section which comprises a first print media core support ear having a fixed upper portion and a lower portion adapted for vertical positional adjustment relative to said fixed upper portion to receive print media rolls of different core diameters, each of said upper and lower portions of said first print media core support ear being semi-circular-shaped of the same diameter, said first print media core support ear being circular-shaped when said lower portion of said first print media core support ear is positioned directly adjacent said upper portion of said first print media core support ear.

2. The apparatus of claim 1, wherein said first print media core support ear further comprises a nob coupled to said lower portion of said first print media core support ear for adjusting the vertical position of said lower portion of said first print media core support ear.

3. The apparatus of claim 2, wherein said lower portion comprises a handle post perpendicularly extending through a vertical slot of said first support member for coupling with said nob, said handle post being tightly movable along said vertical slot.

4. The apparatus of claim 1, wherein each of said upper and lower portions of said first print media core support ear respectively comprises a stepped semicircular rim.

5. The apparatus of claim 4, wherein each stepped semicircular rim comprises a larger semicircular base rim and a smaller semicircular upper rim positioned on said base rim.

6. The apparatus of claim 1, wherein said first support member further comprises a first print media guiding section coupled to said first print media holding section, said first print media guiding section comprises:

a fixed guiding wall;

a curved guiding rail perpendicularly coupled to said guiding wall at a bottom end; and a flat guiding cap perpendicularly coupled to said guiding wall at a front end, said guiding cap being horizontally angled down approximately 10°–20° relative to said front end.

7. An apparatus for mounting print media rolls of different core diameters, said apparatus comprising:

a first support member having a first print media holding section comprising a first print media core support ear having a fixed upper portion and a lower portion adapted for vertical positional adjustment relative to said fixed upper portion to receive print media rolls of different core diameters, each of said upper and lower portions of said first print media core support ear being semi-circular-shaped of the same diameter, said first print media core support ear being circular-shaped when said lower portion of said first print media core support ear is positioned directly adjacent said upper portion of said first print media core support ear; and a second support member disposed opposite said first support member and having a second print media holding section comprising a second print media core support ear having a fixed upper portion and a lower portion adapted for vertical positional adjustment relative to said fixed upper portion to receive print media rolls of different core diameters, each of said upper and lower portions of said second print media core support ear being semi-circular-shaped of the same diameter, said second print media core support ear being circular-shaped when said lower portion of said second print media core support ear is positioned directly adjacent said upper portion of said second print media core support ear, wherein said second print media core support ear further comprises a nob coupled to said lower portion of said second print media core support ear for adjusting the vertical position of said lower portion, said lower portion:comprises a handle post perpendicularly extending through a vertical slot of said second support member for coupling with said nob, said handle post being tightly movable along said vertical slot.

8. The apparatus of claim 7, wherein each of said upper and lower portions of said second print media core support ear respectively comprises a stepped semicircular rim.

9. The apparatus of claim 7, wherein said second support member further comprises a second print media guiding section coupled to said second print media holding section, said second print media guiding section comprises:

a fixed guiding wall;

a curved guiding rail perpendicularly coupled to said guiding wall at a bottom end; and a flat guiding cap perpendicularly coup led to said guiding wall at a front end, said guiding cap being horizontally angled down approximately 10°–20° relative to said front end.

10. An apparatus for mounting print media rolls of different core diameters, said apparatus comprising:

a left support member having a first print media holding section which comprises a first print media core support ear having a fixed upper portion and a lower portion adapted for vertical positional adjustment relative to said fixed upper portion to receive print media rolls of different core diameters and a first print media guiding section-coupled to said first print media holding section;

a right support member disposed opposite said left support member and having a second print media holding section which comprises a second print media core support ear having a fixed upper portion and a lower portion adapted for vertical positional adjustment relative to said fixed upper portion to receive print media rolls of different core diameters and a second print media guiding section coupled to said second print media holding section; and a connecting mechanism coupled between said left and right support members, said connecting mechanism adapted to adjust the spacing between said left and said right support members, said first print media guiding section comprises:

a fixed guiding wall;

a curved guiding rail perpendicularly coupled to said guiding wall at a bottom end; and a flat guiding cap perpendicularly coupled to said guiding wall at a front end, said guiding cap being horizontally angled down approximately 10°–20° relative to said front end.

11. The apparatus of claim 10, wherein said second print media guiding section comprises:

a fixed guiding wall;

a curved guiding rail perpendicularly coupled to said guiding wall at a bottom end; and a flat guiding cap perpendicularly coupled to said guiding wall at a front end, said guiding cap being horizontally angled down approximately 10°–20° relative to said front end.

12. The apparatus of claim 10, wherein said connecting mechanism is a rack-and-pinion mechanism.

13. A media holder comprising a fixed media support member, said media holder comprising:

a first media core support portion securely coupled to the fixed media support member; and a second media core support portion movably coupled to the fixed media support member and adapted for positional adjustment relative to said first media core support portion between a first position in which said second media core support portion is disposed adjacent said first media core support portion and a second position in which said second media core support portion is disposed away from and opposite said first media core support portion for mounting media rolls of different core diameters.

14. The media holder of claim 13, wherein each of said first and second media core support portions is semicircular-shaped, said semicircular-shaped media core support portions being adapted to form a substantially circular media core support when said second media core support portion is in said first position.

15. The media holder of claim 13, further comprising means for adjusting said second media core support portion to various positions relative to said first media core support portion.

16. A print media roll holder comprising a print media core support member having a fixed upper portion, a lower portion adapted for vertical positional adjustment relative to said fixed upper portion to receive print media rolls of different core diameters, and means for adjusting the vertical position of said lower portion relative to said fixed upper portion, said positional adjusting means including a nob coupled to said lower portion and at least one handle post coupled to said nob and extending through at least one vertical slot of said print media core support member, said at least one handle post frictionally moving within said at least one vertical slot to adjust the vertical position of said lower portion relative to said fixed upper portion, said vertical slot and said handle post adapted to hold said lower portion stationary at any desired vertical position within a predetermined range.

17. A print media roll holder, comprising a print media core support member having a fixed upper portion and a lower portion adapted for vertical positional adjustment relative to said fixed upper portion to receive print media rolls of different core diameters, each of said upper and lower portions being semicircular-shaped and of the same diameter, wherein each of said semicircular-shaped upper and lower portions comprises a substantially stepped semicircular rim.

18. The print media roll holder of claim 17, wherein said substantially stepped semicircular rim comprises a base rim and a top rim disposed on said base rim, said base rim being of substantially larger diameter than the diameter of said top rim.

19. A media holder comprising:

a media support member having a recess;

a first media core support portion fixedly coupled to said media support member at one end of said recess; and a second media core support portion movably coupled to said media support member and adapted for positional adjustment within said recess relative to said first media core support portion between a first position in which said second media core support portion is disposed adjacent said first media core support portion and a second position in which said second media core support portion is disposed at an opposite end of said recess, said first and second media core support portions forming an adjustable media core support for mounting media rolls of different core diameters.

20. The media holder of claim 19, wherein said recess is of elliptic shape and each of said first and second media core support portions is semicircular-shaped, said semicircular-shaped media core support portions being adapted to form a substantially circular media core support when said second media core support portion is in said first position.

21. The media roll holder of claim 19, further comprising means for adjusting said second media core support portion to various positions within said recess relative to said first media core support portion.

* * * * *